US011027299B2

(12) United States Patent
Shazuki

(10) Patent No.: US 11,027,299 B2
(45) Date of Patent: Jun. 8, 2021

(54) PRESSURIZED SPRAYER

(71) Applicant: CANYON CORPORATION, Tokyo (JP)

(72) Inventor: Mitsuaki Shazuki, Sanyo Onoda (JP)

(73) Assignee: CANYON CORPORATION, Tokyo (JP)

( * ) Notice: Subject to any disclaimer, the term of this patent is extended or adjusted under 35 U.S.C. 154(b) by 38 days.

(21) Appl. No.: 16/313,020

(22) PCT Filed: Jun. 8, 2017

(86) PCT No.: PCT/JP2017/021325

§ 371 (c)(1),
(2) Date: Dec. 22, 2018

(87) PCT Pub. No.: WO2017/221732

PCT Pub. Date: Dec. 28, 2017

(65) Prior Publication Data

US 2019/0217317 A1 Jul. 18, 2019

(30) Foreign Application Priority Data

Jun. 24, 2016 (JP) ..... JP2016-126094

(51) Int. Cl.
*B05B 11/00* (2006.01)

(52) U.S. Cl.
CPC ..... *B05B 11/0075* (2013.01); *B05B 11/00* (2013.01); *B05B 11/3011* (2013.01)

(58) Field of Classification Search
CPC ..... B05B 11/0064; B05B 11/0067; B05B 11/0075; B05B 11/3011; B05B 11/3016; F04B 9/14

(Continued)

(56) References Cited

U.S. PATENT DOCUMENTS 5,425,477 A * 6/1995 Montaner ..... B05B 11/0005 222/383.1
5,425,482 A * 6/1995 Foster ..... B05B 1/3431 222/207

(Continued)

FOREIGN PATENT DOCUMENTS

JP 08338360 A * 12/1996
JP 2017-013008 A 1/2017
JP 2017-196551 A 11/2017

*Primary Examiner* — Joseph A Greenlund
(74) *Attorney, Agent, or Firm* — Muncy, Geissler, Olds & Lowe, P.C.

(57) ABSTRACT

A pressurized spray A is provided with a cap part 1, a body part 3 capable of being attached to the cap part, a base body 2 that is attached to the body part 3, an introduction pipe 4 for introducing a liquid in a container attached to the base body 2, a nozzle part 5 attached to the body part 3, a cylinder part 6 attached to the body part 3, an F valve 7 attached to the bottom of the cylinder part 6, a piston part 8 that is allowed to slide inside the cylinder part 6, a pivotal trigger 9 that moves the piston part 8 in forward and backward directions, a restoring spring part 13 for restoring the trigger 9, a pressurized valve (S valve 10) attached to a passage of the body part 3, and a pressing spring part 11 for pressing the pressurized valve in a valve closing direction, and by pivotally moving the trigger 9, the pressurized spray A jets out the liquid, and a liquid passage 12 that communicates with the inside of the cylinder part 6 is formed between the base body 2 and the body part 3 so that the liquid located between the pressurized valve and the base body 2 is collected in the container through the liquid passage 12 and the introduction pipe 4.

5 Claims, 13 Drawing Sheets

(58) Field of Classification Search
USPC ..... 239/574, 333; 222/383.1
See application file for complete search history.

(56) References Cited

U.S. PATENT DOCUMENTS 5,622,317 A * 4/1997 Foster ..... B05B 11/0064 239/333
5,711,461 A * 1/1998 Foster ..... B05B 11/0064 222/383.1
6,116,472 A * 9/2000 Wanbaugh ..... B05B 11/3011 222/340
6,131,820 A * 10/2000 Dodd ..... B05B 11/007 239/106
7,497,358 B2 * 3/2009 Clynes ..... B05B 11/3011 222/340
10,040,087 B2 * 8/2018 Fujiwara ..... F16K 15/148
10,512,925 B2 * 12/2019 Nakano ..... B05B 11/0083
2006/0054642 A1 * 3/2006 Buti ..... B05B 11/3074 222/383.1
2006/0086763 A1 * 4/2006 Foster ..... B05B 11/3074 222/383.1
2006/0289679 A1 * 12/2006 Johnson ..... B05B 9/0861 239/333
2008/0149671 A1 * 6/2008 Sweeton ..... B05B 11/0064 222/383.1
2008/0191061 A1 * 8/2008 Inaba ..... B05B 11/3011 239/533.1
2012/0286069 A1 * 11/2012 Foster ..... B05B 11/3077 239/333
2013/0026192 A1 * 1/2013 Alluigi ..... B05B 11/3011 222/383.1
2014/0319244 A1 * 10/2014 Rech ..... B05B 11/304 239/337
2018/0193860 A1 * 7/2018 Furutani ..... B05B 11/3067
2019/0217317 A1 * 7/2019 Shazuki ..... B05B 11/00
2019/0224704 A1 * 7/2019 Shazuki ..... B05B 11/3077

* cited by examiner

PRESSURIZED SPRAYER

TECHNICAL FIELD

The present invention relates to a pressurized spray and more specifically concerns a pressurized spray which causes no liquid leakage to the outside. It is noted that, thorough this application, the pressurized spray may be referred as a pressurized sprayer.

BACKGROUND ART

A liquid jetting spray includes a so-called pressurized spray provided with a special S valve for improving a jetting force.

This pressurized spray generally has a structure in which by sliding a piston relative to a cylinder, a liquid inside the cylinder having a pressure exceeding a fixed pressure is jetted out from a nozzle.

In this case, a portion at which the flow of the liquid is opened/closed is shielded by a valve body and a valve mount, and in a state with an F valve being closed, the liquid that is pressurized by a fixed pressure is pushed out from the inside of the cylinder so that the valve body and the valve mount of the S valve are released from each other.

In this case, the valve body of the S valve is pressed onto the valve mount by a spring and when the liquid pressure inside the cylinder exceeds this pressing force, the valve is opened and the liquid is allowed to pass.

Since the liquid pressure is released, with the valve being suddenly opened, the liquid is energetically jetted out; however, thereafter, the pressure inside the cylinder is released so that the S valve is again shielded.

In this manner, the pressurized spray makes it possible to energetically jet out the liquid inside the cylinder so as to be really effectively utilized.

As the pressurized spray A of this type, for example, some of those disclosed by the present applicant have been proposed (Patent Literature 1, Patent Literature 2, and the like). As the pressurized spray of this type, for example, some of those disclosed by the present applicant have been proposed (Patent Literature 1, Patent Literature 2, and the like).

For example, a trigger spray A in which in a state attached to a container, by moving a piston part (5) by a pivotal movement of a trigger part (T), a pressure is applied to a liquid inside a cylinder of a cylinder structural part (4), the liquid inside the container is jetted out from a nozzle part (3) through a passage (P) is provided, and an F valve (2) installed on the passage between the cylinder part and the container and an S valve (1) installed on a passage part between the cylinder part (42A) and the nozzle part are provided, and in this structure, a valve body (11) of the S valve (1) is pressed onto a valve mount (12) of a raised cylinder part (71) so that by the liquid pressure of the cylinder part, a gap is generated (valve-opened) between the valve body and the valve mount so that the liquid is allowed pass therethrough (for example, see Patent Literature 1).

CITATION LIST

Patent Literature

PTL 1: Japanese Patent Application Laid-Open No. 2015-133133

PTL 2: Japanese Patent Application Laid-Open No. 2016-87581

DISCLOSURE OF INVENTION

Technical Problem

However, in the pressurized spray A described in the above-mentioned Patent Literature 1, since a pressing spring part is installed on an upper side of an S valve, liquid that stays on a side opposite to a liquid passage side of a pressurized valve needs to have such a structure as to release the stayed liquid.

That is, a body part shown in FIG. 13 has a releasing hole G formed therein, and the liquid located in a tightly closed space in which the pressing spring part is located is externally released.

In the case when the liquid stayed therein is not released, a valve lock phenomenon in which the liquid filled the space prevents the movement of the pressing spring part tends to occur.

Since the structure for releasing the liquid to the outside is used, the liquid leaks outside to cause peripheral contamination, or the liquid leaks outside to cause wasteful use of the liquid and consequently to increase costs of the liquid.

In view of these circumstances, the present invention has been devised, and its object is to provide a pressurized spray which prevents leakage of liquid to the outside, thereby preventing peripheral contamination and wasteful use of the liquid.

Solution to Problems

The present inventors have earnestly studied so as to solve the above-mentioned problems, and have found that by providing a revised structure in which the liquid to be originally released to the outside is returned to the container, the above-mentioned problems can be solved; thus, the present invention has been completed.

That is, the present invention relates to a pressurized spray provided with (1) a cap part 1, a body part 3 capable of being attached to the cap part 1, a base body 2 that is attached to the body part 3, an introduction pipe 4 for introducing a liquid in a container attached to the base body 2, a nozzle part 5 attached to the body part 3, a cylinder part 6 attached to the body part 3, an F valve attached to the bottom of the cylinder part 6, a piston part 8 that is allowed to slide inside the cylinder part 6, a pivotal trigger 9 that moves the piston part 8 in forward and backward directions, a restoring spring part 13 for restoring the trigger 9, a pressurized valve (S valve 10) attached to a passage of the body part 3, and a pressing spring part 11 for pressing the pressurized valve in a valve closing direction, and by pivotally moving the trigger 9, the pressurized spray jets out the liquid, and a liquid passage 12 that communicates with the inside of the cylinder part 6 is formed between the base body 2 and the body part 3 so that the liquid located between the pressurized valve and the base body 2 is collected in the container through the liquid passage 12 and the introduction pipe 4.

That is, the present invention relates to the pressurized spray described in the above-mentioned (1) in which (2) the pressing spring part 11 and the base body 2 are integrally formed.

That is, the present invention relates to the pressurized spray described in the above-mentioned (1) in which (3) the pressing spring part 11 and the pressurized valve are integrally formed.

That is, the present invention relates to the pressurized spray described in the above-mentioned (1) in which (4) the introduction pipe 4 is attached to the center portion of the base body 2.

That is, the present invention relates to the pressurized spray described in the above-mentioned (1) in which (5) the pressing spring part 11 is installed at a position that is eccentric from the center of the base body 2.

Advantageous Effects of Invention

The present invention relates to a pressurized spray provided with a cap part 1, a body part 3 capable of being attached to the cap part, a base body 2 that is attached to the body part 3, an introduction pipe 4 for introducing a liquid in a container attached to the base body 2, a nozzle part 5 attached to the body part 3, a cylinder part 6 attached to the body part 3, an F valve 7 attached to the bottom of the cylinder part 6, a piston part 8 that is allowed to slide the inside of the cylinder part 6, a pivotal trigger 9 that moves the piston part 8 in forward and backward directions, a restoring spring part 13 for restoring the trigger 9, a pressurized valve (S valve 10) attached to a passage of the body part 3, and a pressing spring part 11 for pressing the pressurized valve in a valve closing direction, and by pivotally moving the trigger 9, the pressurized spray jets out the liquid, and a liquid passage 12 that communicates with the inside of the cylinder part 6 is formed between the base body 2 and the body part 3 so that the liquid located between the pressurized valve and the base body 2 is collected in the container through the liquid passage 12 and the introduction pipe 4; thus, even when liquid leakage occurs, the liquid is prevented from being externally leaked to cause peripheral contamination, and moreover, no valve lock phenomenon occurs. In addition, the collected liquid into the container can be again utilized for spraying. It is noted that, thorough this application, the F valve and the S valve may be respectively referred as a first valve and a second valve.

Moreover, in the present invention, since the pressing spring part 11 and the base body 2 are integrally formed, the number of parts is reduced and the assembling processes can be easily carried out so that the number of assembling processes at the time of manufacturing the pressurized spray A can also be reduced. Furthermore, the manufacturing costs can be reduced.

Moreover, in the present invention, since the pressing spring part 11 and the pressurized valve are integrally formed, the number of parts is reduced and the assembling processes can be easily carried out so that the number of assembling processes at the time of manufacturing the pressurized spray A can also be reduced. Furthermore, the manufacturing costs can be reduced.

Moreover, in the present invention, the introduction pipe 4 is installed in the center portion of the base body 2; therefore, even when liquid leakage occurs, the collection of the liquid into the container can be carried out smoothly.

Furthermore, in the present invention, since the pressing spring part 11 is installed at a position that is eccentric from the center of the base body 2, an excessive liquid remaining inside the valve can be efficiently collected in the container.

DESCRIPTION OF EMBODIMENTS

Figure 1:
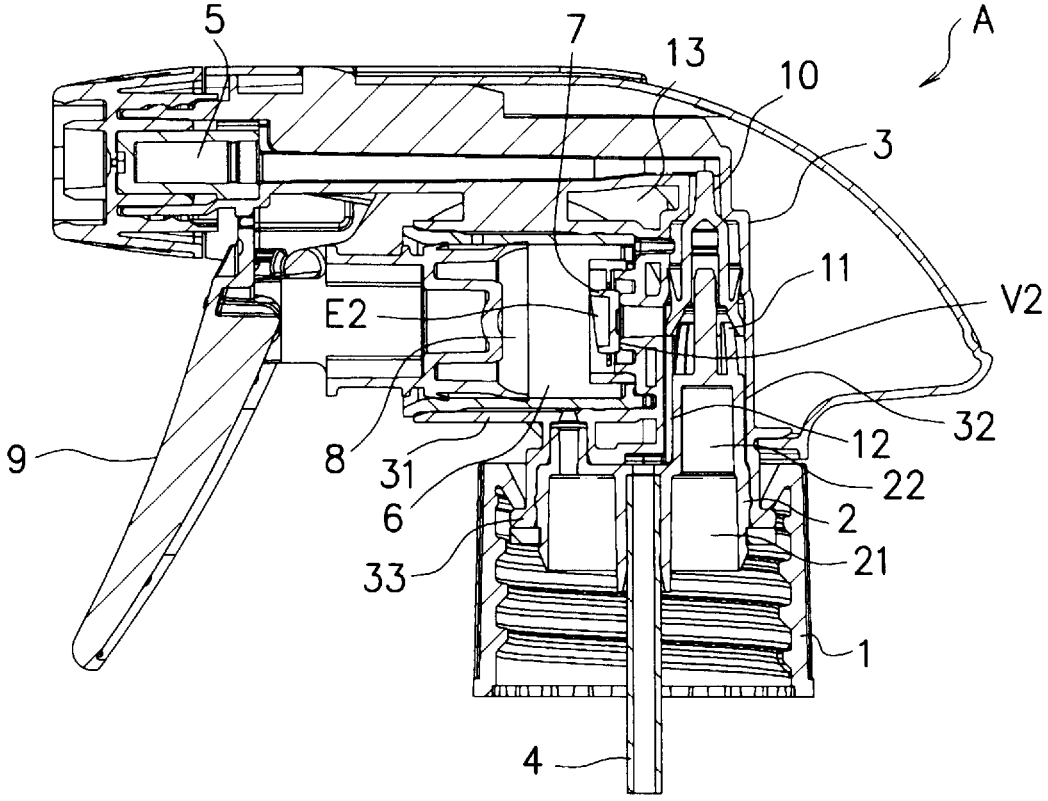
FIG. 1 is a cross-sectional view showing a side face of a pressurized spray.

Referring to drawings on demand, explanation will be given to preferred embodiments of the present invention in detail.

Additionally, in the drawings, the same constituent elements are indicated by the same reference numerals, and overlapped explanations will be omitted.

Moreover, positional relationships, such as upper and lower directions, as well as rightward and leftward directions, are based upon the positional relationships shown in the drawings, unless otherwise specified.

Furthermore, the dimensions and ratios in the drawings are not intended to be limited by those ratios shown in the drawings.

Embodiment

The present invention relates to a pressurized spray A in which no external liquid leakage occurs, without causing a valve lock phenomenon.

The following description will discuss one example of a pressurized spray A.

FIG. 1 is a cross-sectional view showing a side face of the pressurized spray A.

From a viewpoint of functions, the pressurized spray A of the present invention is attached to a container not shown, and brought to a state in which a liquid is filled inside a cylinder part 6, and by applying a pressure to the liquid inside the cylinder part 6 (at this time, F valve 7 is closed, with S valve 10 being opened) by moving a piston part 8 rightward in the drawing by a pivotal movement of a trigger 9, the liquid is jetted out from a nozzle part 5.

Moreover, in contrast, by moving the piston part 8 toward the downstream side (left side in the drawing) by the restoring pivotal movement of the trigger 9, the inside of the cylinder part 6 is negatively pressurized so as to fill the liquid of the container into the cylinder part 6 (at this time, the F valve 7 is opened, with the S valve 10 being closed).

Additionally, the F valve 7 is installed in a liquid passage 12 between the cylinder part 6 and the container, and on the other hand, the S valve 10 is installed in the liquid passage 12 between the cylinder part 6 and the nozzle 5.

With respect to the structure, the pressurized spray A is provided with the nozzle part 5, the body part 3, the cylinder part 6, the piston part 8, the trigger 9, the restoring spring part 13, the S valve 10 and F valve 7, as well as the base body 2 having a pressing spring part 11, the introduction pipe 4, and a cap part 1.

Moreover, a cover body for covering the cylinder part 6, the body part 3 and the base body 2 is provided.

In the body part 3, a cylinder receiving part 31 having a space for press-inserting the cylinder part 6 therein and a base body receiving part 32 having a space for press-inserting the base body 2 therein on a lower side are installed.

The cylinder part 6 is attached by press-inserting to the cylinder receiving part 31 of the body part 3, and further, the base body 2 is attached by press-inserting to the base body receiving part 32 of the body part 3.

Moreover, the nozzle part 5 is attached by press-inserting to the upper side of the body part 3.

The trigger 9 is attached to the body part 3 so as to pivotally move thereon, and is allowed to pivotally return by a restoring spring part 13.

Next, the following description will discuss respective parts that constitute the pressurized spray A.

First, the body part 3 is provided with the cylinder receiving part 31 as described earlier, and the cylinder receiving part 31 is formed into a cylinder shape that opens forward (nozzle part side) in the middle of the body part 3.

Moreover, a rib 33 is formed outward on the lower end of the body part 3, and the rib 33 is sandwiched by the upper end of the cap part 1 and the container. Thus, the body part 3 and the cap part 1 are positively assembled.

The base body receiving part 32 of the body part 3 is opened downward from the body part 3 in association with the shape of the base body 2.

The base body 2 is attached to the mouth part of the container, with the cap part 1 interposed therebetween, in a state attached to the body part 3.

The base body 2 is more specifically provided with a cylinder shaped fixing part 21 and a raised cylinder part 22 that extends upward therefrom.

Moreover, onto the lower side in the middle portion, the introduction pipe 4 that communicates with the container is attached by press-insertion.

In a state in which the raised cylinder part 22 of the base body 2 is attached to the base body receiving part 32 of the body part 3, a space having a fixed width is partitioned on the upper portion of the base body receiving part 32.

In the corresponding space, the S valve 10 to be described later is installed.

Moreover, at a position separated from the center portion of the base body 2 when seen from a top view (in other words, an eccentric position from the attached position of the introduction pipe 4), the pressing spring part 11 and the aforementioned raised cylinder part 22 are disposed in the vertical direction.

In this case, the pressing spring part 11 is integrally formed with the base body 2 by using an injection molding process or the like. More specifically, it is installed in a raised form from the upper end of the raised cylinder part 22 of the base body 2. Thus, the number of parts can be reduced.

Moreover, by being integrally formed, the position of the pressing spring part 11 can be fixed so that the pressing force to the S valve 10 is precisely transmitted.

In the present embodiment, the pressing spring part 11 is formed into a cylinder shape with a slightly narrowed tip, and the wall of the cylinder is provided with cut-outs in equal intervals.

In the present embodiment, the cut-outs are formed at three portions so that the pressing spring part 11 is constituted by three divided pieces.

With this arrangement, the elastic pressure of the pressing spring part 11 is transmitted to the S valve uniformly without deviation.

Furthermore, in the case when the pressing spring part 11 applies an elastic pressing force to the lower side of the flange part 10*b* of the S valve 10, the axis centers of the S valve 10 and the pressing spring part 11 are maintained in a stable manner.

Since the pressing spring part 11 is constituted by plate springs, a high elastic pressing force can be obtained.

The liquid passage 12 between the introduction pipe 4 and the F valve 7 is partitioned by the inner circumferential wall of the body part 3 and the outer wall of the raised cylinder part 22 of the base body 2 so as to have a slit shape.

The F valve 7 is installed between the cylinder part 6 and the liquid passage 12, and more specifically formed on the bottom portion of the cylinder part 6.

The F valve 7 is used for shielding the liquid on the container side from the liquid inside the cylinder part 6 or for joining these with each other.

After upon application of a pressure onto the cylinder part 6, the liquid therein has been jetted outside, since the piston part 8 tries to return to its original position, the inside of the cylinder part 6 is reduced in pressure, and since the liquid is sucked into the cylinder part 6 from the liquid passage 12, the F valve 7 is opened.

The F valve 7, which exerts a valve function between a second valve body E2 and a second valve mount V2, and an annular protruding part formed on the bottom part of the body part 3 exerts the role of the second valve mount V2.

At the time of a normal operation, the second valve body E2 is made in contact with the second valve mount V2 in an elastically pressing manner, and at the time of the valve opening, it is separated therefrom.

That is, by receiving a pressure from the liquid sucked from the container, the second valve body E2 of the F valve 7 is moved in parallel on the downstream side (to the left side in the drawing) so that the valve is opened.

Figure 2:
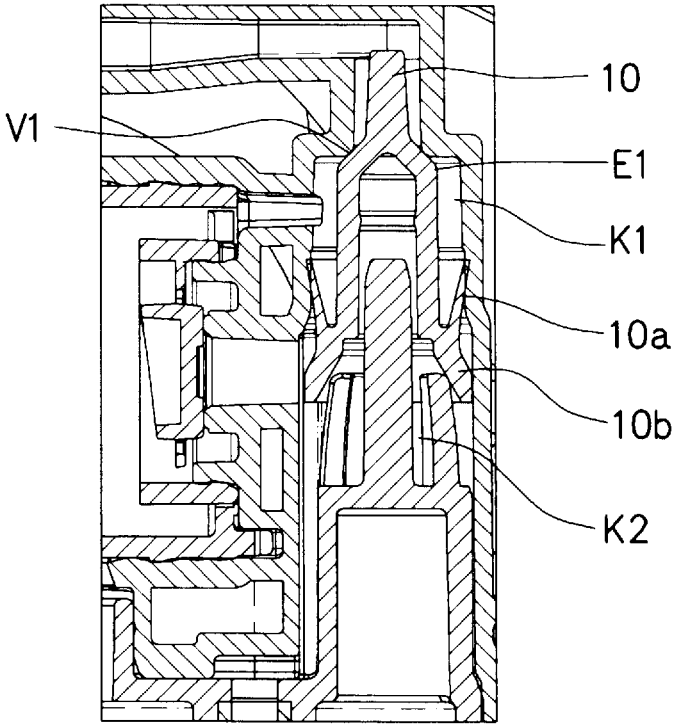
FIG. 2 is a cross-sectional view showing a portion having an S valve assembled therein in an enlarged manner.

Next, explanation will be given to the S valve 10. FIG. 2 is a cross-sectional view that shows a part assembled into the S valve 10 in an enlarged manner. The S valve 10 is constituted by a valve lip part 10*a* formed on the lower side of the first valve body E1 and the flange part 10*b* formed on the lower side.

The S valve 10 is disposed inside (space partitioned by the base body 2 and the inner circumferential wall of the body part 3) the body part 3.

The inner circumferential wall of the body part 3 on which the S valve 10 is disposed has a step part V1 with its upper portion having a narrowed diameter.

This step part V1 exerts a function for the first valve mount V1 of the S valve 10. The first valve body E1 of the S valve 10 has a slant face E1 that is opposed to the step difference part V1, and this slant face E1 is made in contact with the step difference part V1 of the body part 3. This slant face E1 of the S valve 10 is raised upward by the pressing spring part 11 so as to be made in contact with the step difference part V1 of the inner circumferential wall of the body part 3 in an elastically pressing manner.

On the lower side of the S valve 10, the valve lip part 10*a* that is gradually expanded upward is formed, and made in contact with the inner circumferential wall of the body part 3 in an elastically pressing manner.

That is, by the valve lip part 10*a*, an upper space K1 that is a space between the inner circumferential wall of the body part 3 and first valve body E1 and a lower space K2 that is a space between the lower portion of the S valve 10 as well as the inner circumferential wall of the body part 3 and base body 2 are shielded from each other.

As described above, since the first valve mount V1 corresponding to the step difference part V1 of the body part 3 and the first valve body E1 of the S valve 10 are made in contact with each other in an elastically pressing manner, the upper space K1 is set to a tightly closed state.

On the other hand, the lower space K2 lower than the valve lip part 10*a* is communicated with the liquid passage 12 between the inner circumferential wall of the body part 3 and the outer wall of the raised cylinder part 22 of the base body 2.

On the lower side of the valve lip part 10*a*, the flange part 10*b* extending downward in a skirt shape is formed.

The flange part 10*b* is moved while sliding on the inner circumferential wall of the body part 3 at the time when the S valve 10 moves vertically, so as to guide the S valve 10.

In the case when the piston part 8 is moved by the operation of the trigger 9 so that the liquid pressure is applied onto the upper space K1 that is communicated with the cylinder part 6, the S valve 10 is allowed to slide downward by overcoming the spring force of the pressing spring so that a gap between the first valve mount V1 corresponding to the step difference part V1 of the aforementioned body part 3 and the slant part of the first valve body E1 of the S valve 10 is opened (valve-opened).

Thus, the liquid pushed out from the upper space K1 is allowed further flow into the nozzle part 5, and jetted outside from the nozzle part 5.

When the liquid is jetted out to cause the liquid pressure applied to the upper space K1 to be lowered, the elastic pressing force of the pressing spring part 11 pushes the S valve 10 upward this time, with the result that the S valve 10 is made in contact with the first valve mount V1 corresponding to the step difference part V1 of the body part 3 in an elastically pressing manner (valve-closed).

Thus, the upper space K1 is again tightly sealed.

In a state where the S valve 10 is closed, the trigger 9 is returned to the original position by the restoring spring part 13.

At this time, when the piston part 8 is moved by the trigger 9, the inside of the cylinder is negatively pressurized so that the liquid inside the container is sucked into the cylinder through the F valve 7 through the introduction pipe 4 (S valve 10 is closed with the F valve 7 being opened).

FIGS. 3 to 6 are drawings that shows a sequence of processes in which after pulling the trigger 9, the trigger 9 is returned to the original position by the restoring spring part 13.

Figure 3:
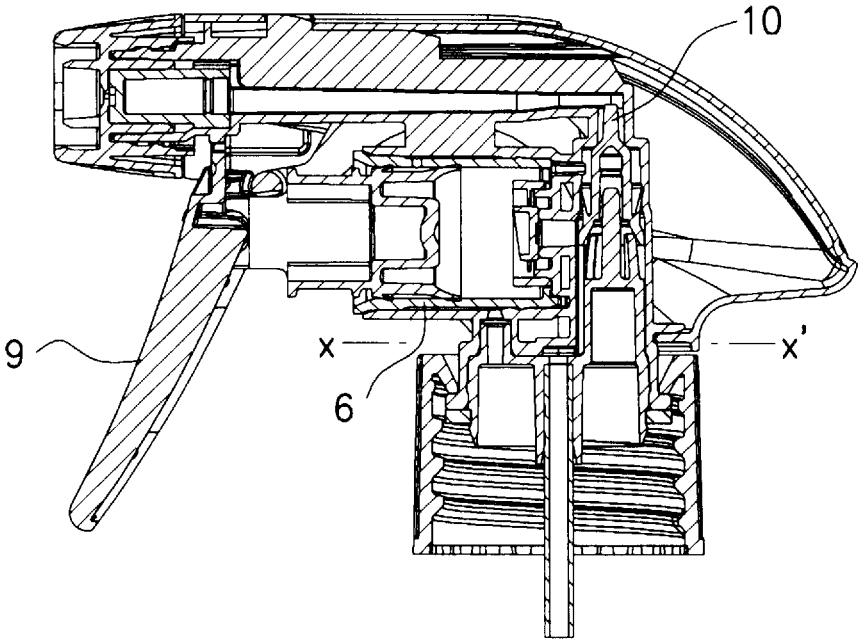
FIG. 3 is a cross-sectional view showing the side face of a pressurized spray in which a trigger is not pulled.

FIG. 3 is a cross-sectional view showing the side face of the pressurized spray A in which the trigger 9 is not pulled.

Figure 4:
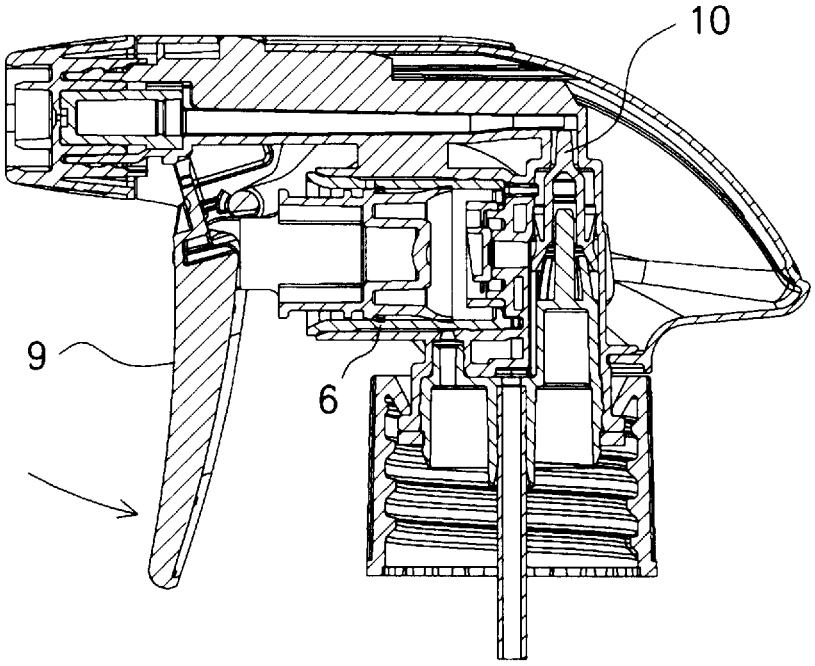
FIG. 4 is a cross-sectional view showing the side face of the pressurized spray in a state during which the trigger is being pulled.

FIG. 4 is a cross-sectional view showing the side face of the pressurized spray A in a state during which the trigger 9 is being pulled.

Figure 5:
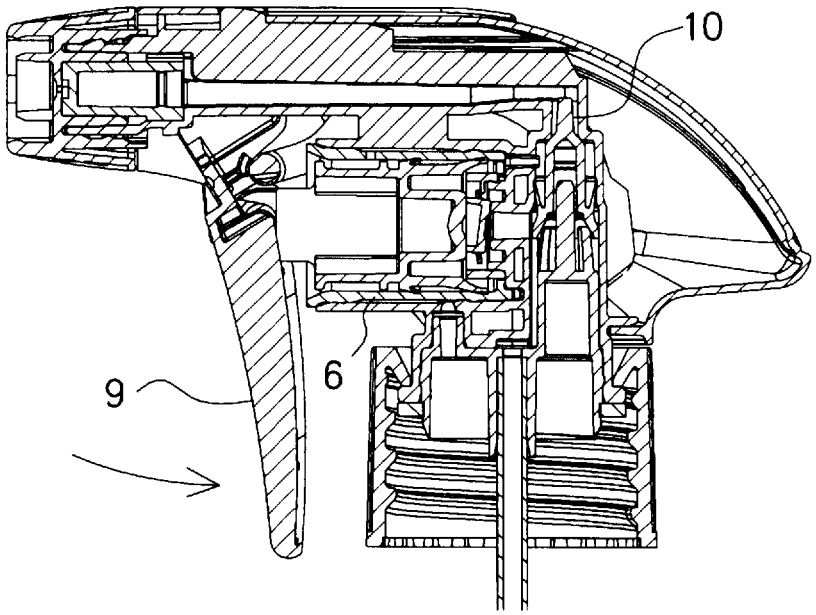
FIG. 5 is a cross-sectional view showing the side face of the pressurized spray in a state in which pulling the trigger has been completed.

FIG. 5 is a cross-sectional view showing the side face of the pressurized spray A in a state in which pulling the trigger 9 has been completed.

Figure 6:
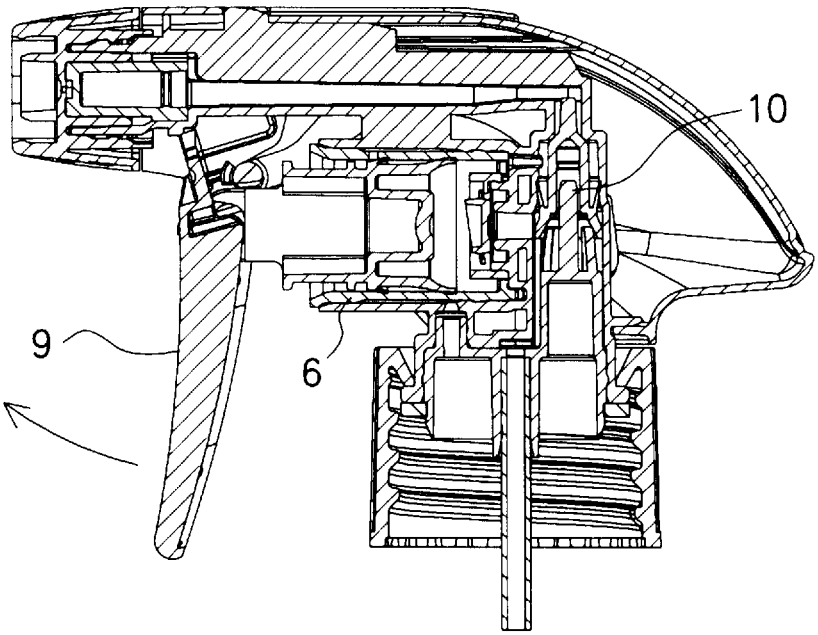
FIG. 6 is a cross-sectional view showing the side face of the pressurized spray in a state during which the trigger is returned to its original position by a restoring spring part.

FIG. 6 is a cross-sectional view showing the side face of the pressurized spray A in a state during which the trigger 9 is returning to its original position by a restoring spring part 13.

Figure 7:
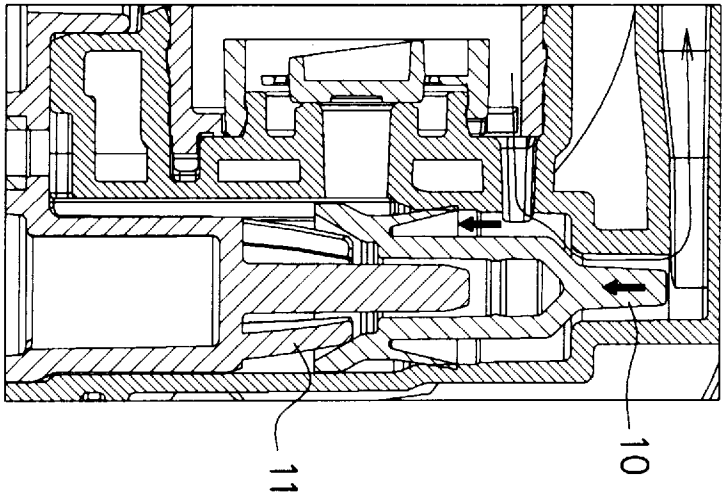
FIG. 7 is a cross-sectional view showing a side face of an S valve in a pressed down state by a liquid pressure inside an upper space.

FIG. 7 is a cross-sectional view showing a side face of an S valve 10 that is pressed down by a liquid pressure inside the upper space K1.

Next, the following description will discuss the flow of a liquid. By the operation of the trigger 9, the liquid inside the container is sucked up through the introduction pipe 4 and through the liquid passage 12 between the inner circumferential wall of the body part 3 and the outer wall of the base body 2, the liquid is further sucked up and sent toward the cylinder part 6 through the F valve 7.

Thereafter, the liquid is pushed out toward the upper space K1 to reach the nozzle part 5 through the S valve 10, thereby jetted out externally.

In this case, in the pressurized trigger 9, in the case of a failure in the valve lip part 10*a*, leakage of the liquid from the upper space K1 to the lower space K2 sometimes occurs.

By this problem, in the case when more specifically, the liquid is filled into the peripheral space of the pressing spring part 11, that is, the lower space K2, and the liquid is in the tightly closed state, a so-called valve lock state in which the movement of the S valve 10 is prevented tends to occur.

However, by the use of the pressurized spray A of the present invention, this tightly closed state can be avoided.

Figure 8:
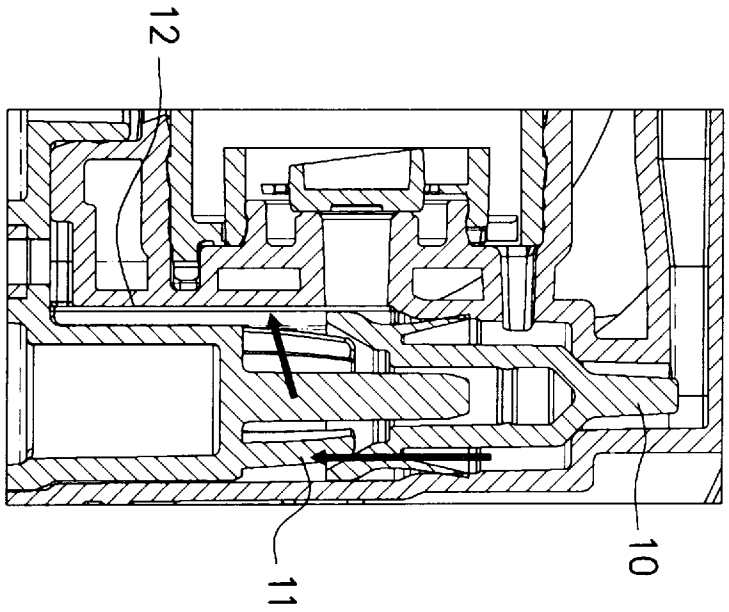
FIG. 8 is a cross-sectional view showing the side face of the S valve in a state where a liquid leakage occurs.

FIG. 8 shows a cross-sectional view showing an enlarged side face of the S valve 10 at the time of occurrence of a liquid leakage.

That is, in the S valve 10 of the present invention, the pressing spring part 11 is installed below the S valve 10 so that in the case when the pressure of the liquid of the upper side of the S valve 10 becomes excessive, or when a failure occurs in the valve lip part 10*a*, the liquid filled above the S valve 10 tends to enter the pressing spring part 11 side (lower space K2) through the gap between the valve lip 10*a* and the body inner circumferential wall.

In the present invention, however, since the lower space K2 in which the pressing spring part 11 is housed is continuously connected to the container through the liquid passage 12 formed between the inner circumferential wall of the body part 3 and the outer wall of the raised cylinder part 22 of the base body 2, the excessive liquid is maintained in a state capable of being always released to the container so that even if the liquid is filled, the vertical sliding movement of the S valve 10 is not prevented.

That is, no valve lock is caused.

Figure 9:
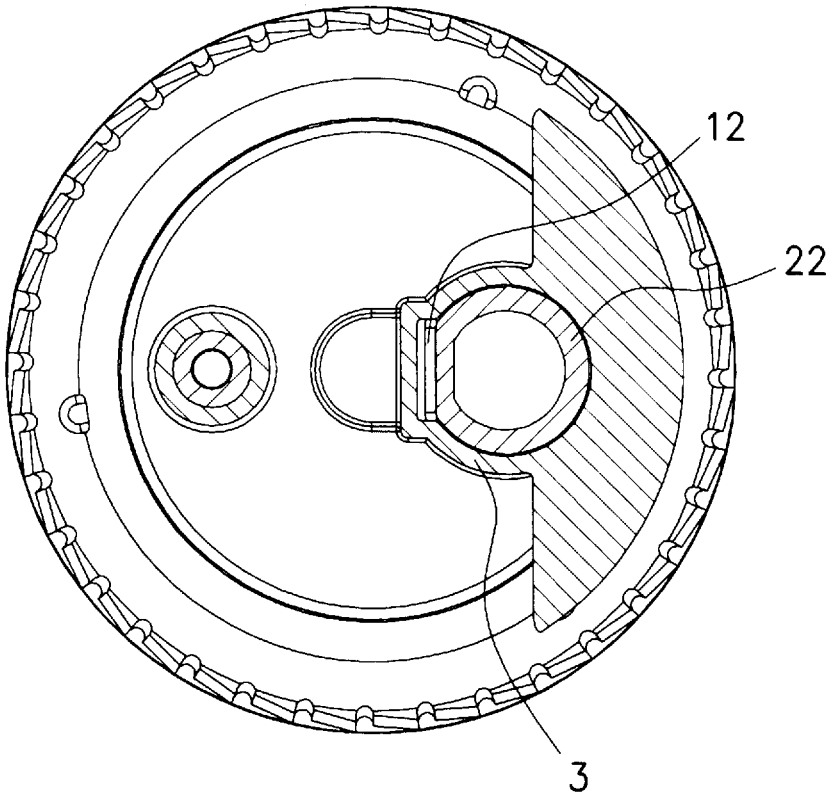
FIG. 9 is a cross-sectional view taken along line X-X' in FIG. 3.

FIG. 9 is a cross-sectional view taken along line X-X' in FIG. 3.

As described earlier, the liquid passage 12 is partitioned by the outer wall of the base body 2 and the inner circumferential wall of the body part 3.

The lower space K2 located right below the valve lip part 10*a* is integrally formed together with the space communicated with the liquid passage 12 from the upper space K1 so that even if a liquid leakage occurs into the lower space K2 from the upper space K1, the leaked out liquid reaches the introduction pipe 4 through the liquid passage 12 and collected by the container.

In this manner, the lower space K2 is always communicated with the container through the liquid passage 12; therefore, even if the liquid is filled in the lower space K2, the movement of the S valve 10 is not prevented so that no valve block is caused. In this manner, the lower space K2 is always communicated with the container through the liquid passage 12; therefore, even when the liquid is filled in the lower space K2, the movement of the S valve 10 is prevented from being hindered and no valve lock phenomenon occurs.

Therefore, different from the conventional mechanism in which a releasing hole toward the outside is formed, since no liquid is leaked externally, it is possible to prevent peripheral contamination.

Moreover, since the collected liquid into the container can be again utilized for spraying, no wasteful use is caused.

Explanation has been given above to preferred embodiments of the present invention; however, the present invention is not intended to be limited by the above-mentioned embodiments.

The cylinder wall of the pressing spring part 11 has cut-out portions with equal intervals; however, the number of divided cut-out portions may be set to two or more.

Figure 10:
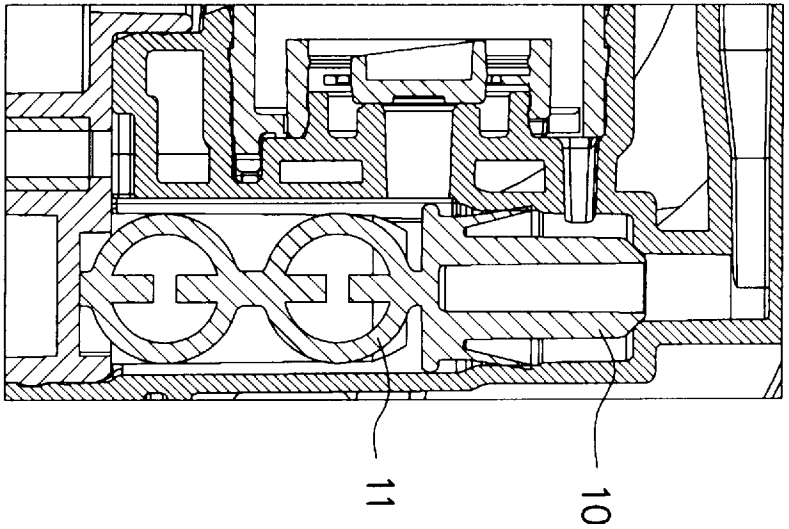
FIG. 10 is a cross-sectional view showing a side face of an S valve in accordance with another embodiment.

The shape of the attaching base part can be altered. For example, the attaching base part may be designed so that a pressing spring part to be integrally formed on its upper surface is formed into two cylinder bodies overlapped with one on the other (see FIG. 10).

When these cylinder bodies receive a pressure from above, these are compressed to exert a restoring force.

The lower surface of the S valve 10 is made in contact with a circular plate formed on these cylinder bodies, and when the cylinder bodies are in a slightly compressed state, the valve body of the S valve is pressed onto the valve mount so as to be valve-closed.

Figure 11:
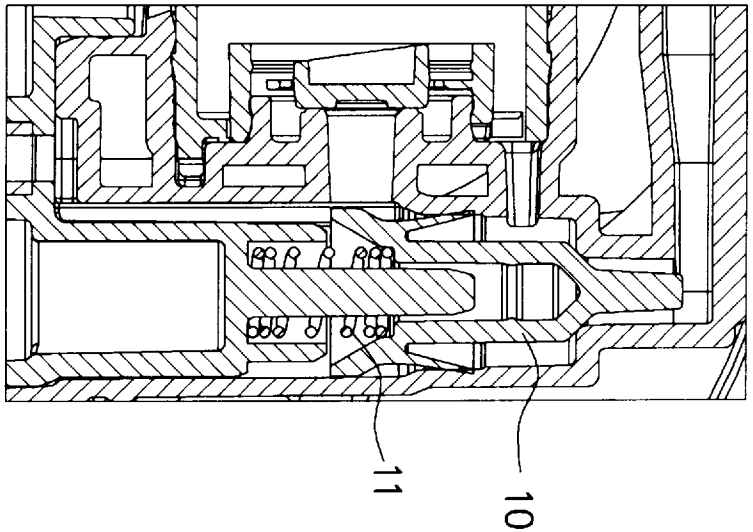
FIG. 11 is a cross-sectional view showing a side face of an S valve in accordance with the other embodiment.
Figure 12:
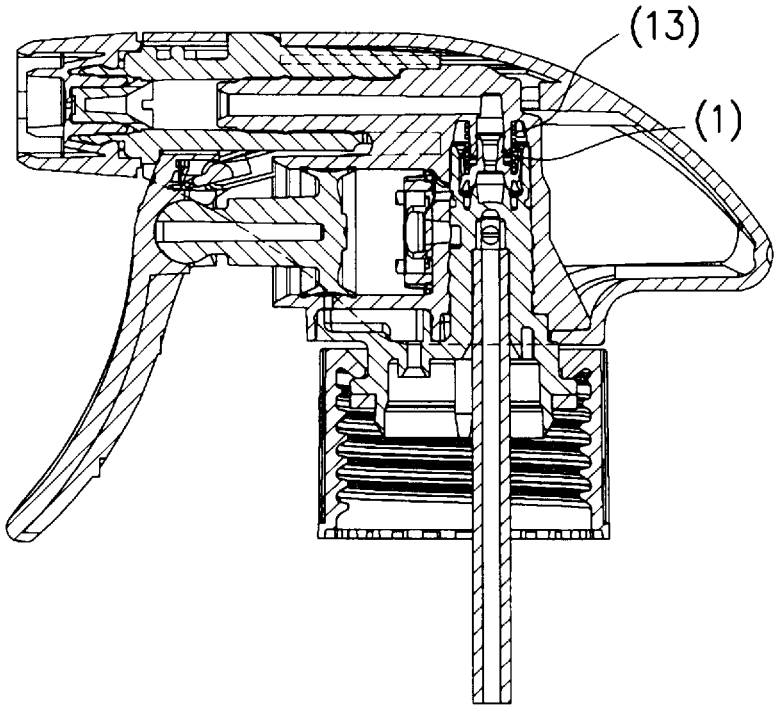
FIG. 12 is a cross-sectional view showing a side face of a pressurized spray of a prior-art technique.
Figure 13:
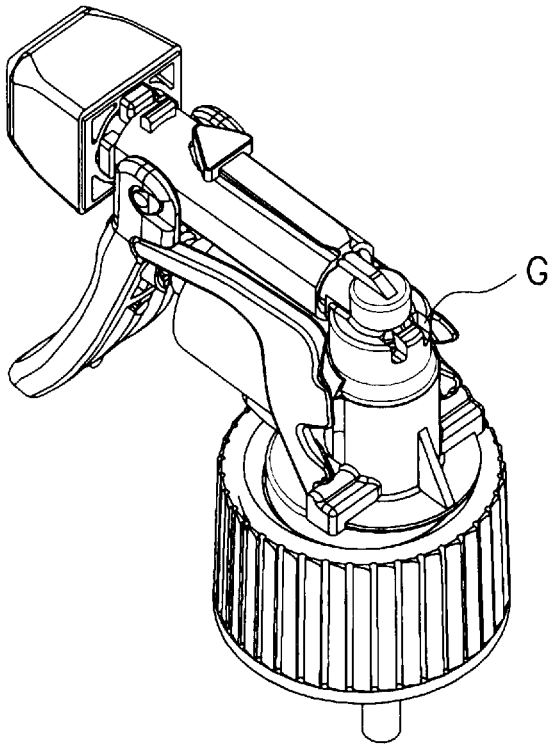
FIG. 13 is a perspective view showing the pressurized spray of the prior-art technique.

Moreover, the pressing spring part is formed as a part different from the attaching base part and the S valve, and may be formed by using metal (see FIG. 11).

Additionally, as a material for the above-explained base body 2, materials such as thermoplastic resin (resin pp), polyacetal (POM) or the like may be desirably used.

INDUSTRIAL APPLICABILITY

The pressurized spray A of the present invention can be widely used for the purpose of spraying a liquid irrespective of industrial use or home use. Since the excessive liquid inside the valve is returned, the utilization efficiency is high and it is possible to prevent peripheral contamination. In addition, since the pressing spring part 11 is integrally formed together with the base body 2, the pressing force onto the S valve is effectively exerted and high spraying efficiency can be expected as the pressurized spray A.

REFERENCE SIGNS LIST

A . . . pressurized spray,
1 . . . cap part,
2 . . . base body,
21 . . . fixed part,
22 . . . raised cylinder part,
3 . . . body part,
31 . . . cylinder body receiving part,
32 . . . base body receiving part,
33 . . . rib,
4 . . . introduction pipe,
5 . . . nozzle part,
6 . . . cylinder part,
7 . . . F valve,
8 . . . piston part,
9 . . . trigger,
10 . . . S valve,
10*a* . . . valve lip part,
10*b* . . . flange part,
11 . . . pressing spring part,
12 . . . liquid passage,
13 . . . restoring spring part,
E1 . . . first valve body (slant surface),
E2 . . . second valve body
V1 . . . first valve mount (step difference part),
V2 . . . second valve mount
K1 . . . upper space,
K2 . . . lower space

The invention claimed is:

1. A pressurized sprayer comprising:
a cap part;
a body part capable of being attached to the cap part;
a base body that is attached to the body part;
an introduction pipe for introducing a liquid in a container attached to the base body;
a nozzle part attached to the body part;
a cylinder part attached to the body part;
a first valve attached to a bottom of the cylinder part;
a piston part that is allowed to slide inside the cylinder part;
a pivotal trigger that moves the piston part in forward and backward directions;
a restoring spring part for restoring the trigger;
a pressurized valve attached to a passage of the body part; and
a pressing spring part for pressing the pressurized valve in a valve closing upward direction, wherein the cap part is in a downward direction from the pressurized valve,
wherein by pivotally moving the trigger, the pressurized sprayer jets out the liquid, and a liquid passage that communicates with an inside of the cylinder part is formed between the base body and the body part so that the liquid located between the pressurized valve and the base body is collected in the container through the liquid passage and the introduction pipe.

2. The pressurized sprayer according to claim 1, wherein the pressing spring part and the base body are integrally formed.

3. The pressurized sprayer according to claim 1, wherein the pressing spring part and the pressurized valve are integrally formed.

4. The pressurized sprayer according to claim 1, wherein the introduction pipe is attached to a center portion of the base body.

5. The pressurized sprayer according to claim 1, wherein the pressing spring part is formed at a position that is eccentric from the center of the base body.

* * * * *